US011632647B1

(12) United States Patent
Feng et al.

(10) Patent No.: US 11,632,647 B1
(45) Date of Patent: Apr. 18, 2023

(54) SYSTEM AND METHOD FOR RENDERING REAL-TIME SPATIAL AUDIO IN VIRTUAL ENVIRONMENT

(71) Applicant: Agora Lab, Inc., Santa Clara, CA (US)

(72) Inventors: Jianyuan Feng, Shanghai (CN); Ruixiang Hang, Shanghai (CN)

(73) Assignee: Agora Lab, Inc., Santa Clara, CA (US)

( * ) Notice: Subject to any disclaimer, the term of this patent is extended or adjusted under 35 U.S.C. 154(b) by 66 days.

(21) Appl. No.: 17/520,956

(22) Filed: Nov. 8, 2021

(51) Int. Cl.
*H04S 7/00* (2006.01)

(52) U.S. Cl.
CPC ..... *H04S 7/304* (2013.01); *H04S 2400/01* (2013.01); *H04S 2400/11* (2013.01); *H04S 2400/15* (2013.01); *H04S 2420/01* (2013.01)

(58) Field of Classification Search
CPC .. H04S 7/304; H04S 2400/01; H04S 2400/11; H04S 2400/15; H04S 2420/01
USPC ..... 381/310
See application file for complete search history.

(56) References Cited

U.S. PATENT DOCUMENTS 11,516,616 B2 * 11/2022 Boerum ..... H04S 7/304

OTHER PUBLICATIONS

Image method for efficiently simulating small-room acoustics, Jont B. Allen, et al., Acoustics Research Department, Bell Laboratories, Murray Hill, New Jersey 07974, 1979 Acoustical Society of America, pp. 943-950.

* cited by examiner

*Primary Examiner* — Paul Kim
(74) *Attorney, Agent, or Firm* — The Law Offices of Konrad Sherinian; Depeng Bi

(57) ABSTRACT

A new real-time spatial audio rendering system includes a real-time spatial audio rendering computer software application adapted to run on a communication device. The application renders stereo audio from mono audio sources in a virtual room of a listener. The listener can be mobile. The stereo audio is rendered for each listener within the room. The real-time spatial audio rendering system has two different modes, with and without reverberation. Reverberation can provide the sense of the dimensions of the room, First, the anechoic processing module produces the anechoic stereo audio that provides the sense of direction and distance of spatial audio. When reverberation is desired, the reverberation processing module is also performed to provide the sense of the room's dimensions by the spatial audio.

15 Claims, 8 Drawing Sheets

SYSTEM AND METHOD FOR RENDERING REAL-TIME SPATIAL AUDIO IN VIRTUAL ENVIRONMENT

CROSS REFERENCE TO RELATED APPLICATIONS

NONE.

FIELD OF THE DISCLOSURE

The present invention generally relates to audio rendering in real-time communications, and more particularly relates to real-time spatial audio rendering in a virtual environment. More particularly still, the present disclosure relates to a system and method for rendering real-time stereo audio in a virtual environment.

DESCRIPTION OF BACKGROUND

In real-world communication, people can hear from audio sources and distinguish the direction and distance of the sources. Such determination is based on the binaural effect. The binaural effect requires that the sound wave signals, received by the listener's two ears, have two different time delays and spectral energy distributions. Therefore, spatial audio should have at least two channels (stereo audio) to provide the binaural effect for a user in a real-time communication environment, such as an online game environment. Participating people (or participants in short) are in different room conditions in real-time communication (RTC) virtual environments, such as an online meeting room or a virtual theater. They can move from one place to another within their own rooms. There may be multiple audio sources such as people speaking, TVs, etc. in a room.

However, for real-tune communication, many devices such as laptops or mobile phones may only support mono-channel recording. Even the devices support stereo recording, the audio codec used by the RTC application may not support stereo audio. As a result, the audio in RTC virtual environment is often in mono format. Besides the limitation of hardware and audio codec, in the RTC virtual environment, the position of each speaker can be varying. In another word, the mono audio signals require a new real-time spatial audio rendering system to generate stereo audio according to the real-time positions of sound sources and listeners. An illustrative virtual environment is shown in FIG. 8. In the virtual environment (also referred to herein as a room and virtual room), there are three audio sources Audio1 (a1, b1, c1), Audio2 (a2, b2, c2), and Audio3 (a3, b3, c3) with the listener (such as an avatar) located at (a0, b0, c0). The room's width, length and height are denoted by a, b and c.

Accordingly, there is a need for a new audio rendering system and method that generate stereo audio for a listener in a virtual environment. With mono audio signals from an audio source, the real-time virtual positions of the listener and audio sources, and the real-time orientations of the listener, the real-time spatial audio rendering system need to provide real-time stereo audio signals for each listener with minimal time delay. The audio sources will be rendered and mixed into a stereo playback format for the listener in the virtual room through the real-time spatial audio rendering system. Furthermore, the listener can distinguish each audio source's direction and distance with the stereo audio, which makes the virtual RTC environment closer to a real-world listening experience. In addition, the real-time spatial audio rendering system needs to generate stereo audio signals with reverberation effects.

SUMMARY OF THE DISCLOSURE

Generally speaking, pursuant to the various embodiments, the present disclosure provides a computer-implemented method for rendering real-time spatial audio from mono audio sources in a virtual environment. The method is performed by a real-time spatial audio rendering computer software application within a real-time spatial audio rendering system and includes determining whether reverberation is configured for rendering spatial audio from a set of mono audio sources; determining a set of dynamic locations of the set of mono audio sources relative to a listener's location in a virtual environment respectively; obtaining a set of discrete Head-Related Impulse Responses (HRIRs), converting the set of discrete HRIRs into continuous HRIRs; determining interaural time differences of each mono audio source within the set of mono audio sources based on the set of dynamic locations; modifying said continuous HRIRs with said interaural time differences to generate modified HRIRs; applying gain control on audio signals of each mono audio source within the set of mono audio sources to generate modified audio signals; convoluting the modified audio signals by the modified HRIRs to generate spatial audio signals of each mono audio source within the set of mono audio sources; and combining the spatial audio signals of all mono audio sources within the set of mono audio sources to generate anechoic audio, the anechoic audio adapted to be played back by the communication device. The spatial audio is stereo audio. The method further includes compressing the anechoic audio's level o a target range for playback by the communication device wherein the spatial audio is stereo audio.

When reverberation is configured, the method further includes generating Binaural Room Impulse Responses (BRIRs) based on a set of dimensions of a room of the listener and positions of the listener and the set of mono audio sources; convoluting the audio signals of each mono audio source within the set of mono audio sources with the BRIRs to generate reverberation stereo audio of each mono audio source within the set of mono audio sources; combining the reverberation stereo audio of all mono audio source within the set of mono audio sources to generate combined reverberation audio; and mixing the anechoic audio with the combined reverberation audio for both a left channel and a right channel to generate final spatial audio for playback on the communication device.

Further in accordance with the present teachings is a real-time spatial audio rendering system having a real-time spatial audio rendering computer software application adapted to run on a communication device. The real-time spatial audio rendering computer software application is adapted to determine whether reverberation is configured for rendering spatial audio from a set of mono audio sources; determine a set of dynamic locations of the set of mono audio sources relative to a listener's location in a virtual environment respectively; obtain a set of discrete Head-Related Impulse Responses (HRIRs); convert the set of discrete HRIRs into continuous HRIRs; determine interaural time differences of each mono audio source within the set of mono audio sources set of dynamic locations; modify said continuous HRIRs with said interaural time differences to generate modified HRIRs; apply gain control on audio signals of each mono audio source within the set of mono audio sources to generate modified audio signals, convolute the modified audio signals by the modified HRIRs to generate spatial audio signals of each mono audio source within the set of mono audio sources; and combine the spatial audio signals of all mono audio sources within the set of mono audio sources to generate anechoic audio, the anechoic audio adapted to be played back by the communication device. In one implementation, the spatial audio is stereo audio. The real-time spatial audio rendering computer software application is further adapted to compress the anechoic audio's level to a target range for playback by the communication device.

When reverberation is configured, the real-time spatial audio rendering computer software application is further adapted to generate Binaural Room Impulse Responses (BRIRs) based on a set of dimensions of a room of the listener and positions of the listener and the set of mono audio sources; convolute the audio signals of each mono audio source within the set of mono audio sources with the BRIRs to generate reverberation stereo audio of each mono audio source within the set of mono audio sources; combine the reverberation stereo audio of all mono audio source within the set of mono audio sources to generate combined reverberation audio; and mix the anechoic audio with the combined reverberation audio for both a left channel and a right channel to generate final spatial audio for playback on the communication device. In a further implementation, the real-time spatial audio rendering computer software application is further adapted to compress the final spatial audio's level to a target range.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skill in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

The new real-time (RT) spatial audio rendering system provides stereo audio output with or without reverberation. Reverberation provides the sense of dimensions of the virtual room size. Reverberation is not necessarily required depending on the usage because too much reverberation may reduce the intelligibility and not suitable for certain situations, such as a virtual meeting over the Internet with multiple participants. The RT spatial audio rendering system, in one implementation, includes a computer software application (also referred to herein as real-time spatial audio rendering computer software application) running on a communication device operated by the listener or a server computer for providing stereo audio to a listener from mono audio signals from one or more audio sources. When the server computer performs the spatial audio rendering, the computer software application obtains the input data from the listener's communication device over an Internet connection, generates the stereo audio and forwards the stereo audio data to the listener's communication device over the Internet for playback by the same device. The spatial audio rendering software application includes one or more computer programs that are written in computer software programming languages, such as C, C++, C#, Java, etc.

Figure 1:
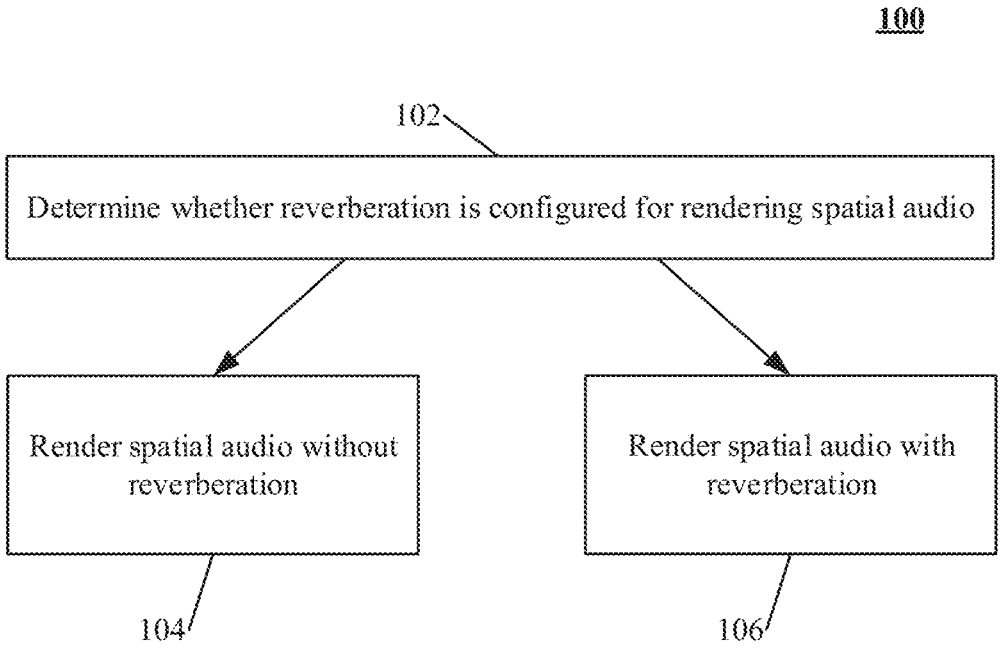
FIG. 1 is a flowchart illustrating a process by which a real-time spatial audio rendering systems provides spatial audio in accordance with this disclosure.

The process by which the RT spatial audio rendering software application provides spatial audio (such as stereo audio) is further shown and generally indicated at 100 in FIG. 1. Referring to FIG. 1, at 102, the RT spatial audio rendering software application determines whether reverberation is configured. If not, at 104, the RT spatial audio rendering software application renders spatial audio without reverberation. The generated spatial audio incorporates direction and distance factors for the listener. In other words, the spatial audio provides the sense of direction and distance. Such spatial audio is also referred to herein as anechoic audio, anechoic audio signals and anechoic sound. If reverberation is desired, at 106, the RT spatial audio rendering software application renders spatial audio with reverberation. The configuration of the need for reverberation can be achieved by user input via a user input interface or a configuration setting.

Figure 2:
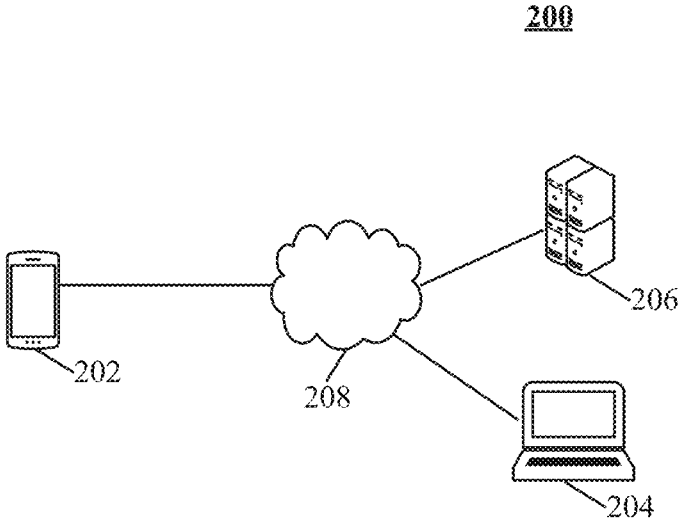
FIG. 2 is a block diagram illustrating a real-time communication system with a real-time spatial audio rendering system in accordance with this disclosure.

The communication device and a server computer are further illustrated by reference to FIGS. 2, 3 and 4. Referring first to FIG. 2, a block diagram illustrating a real-time communication system is shown and generally indicated at 200. Two illustrative communication devices are indicated at 202 and 204. The server computer is indicated at 206. These electronic devices 202-206 are adapted to access the Internet 208.

Figure 3:
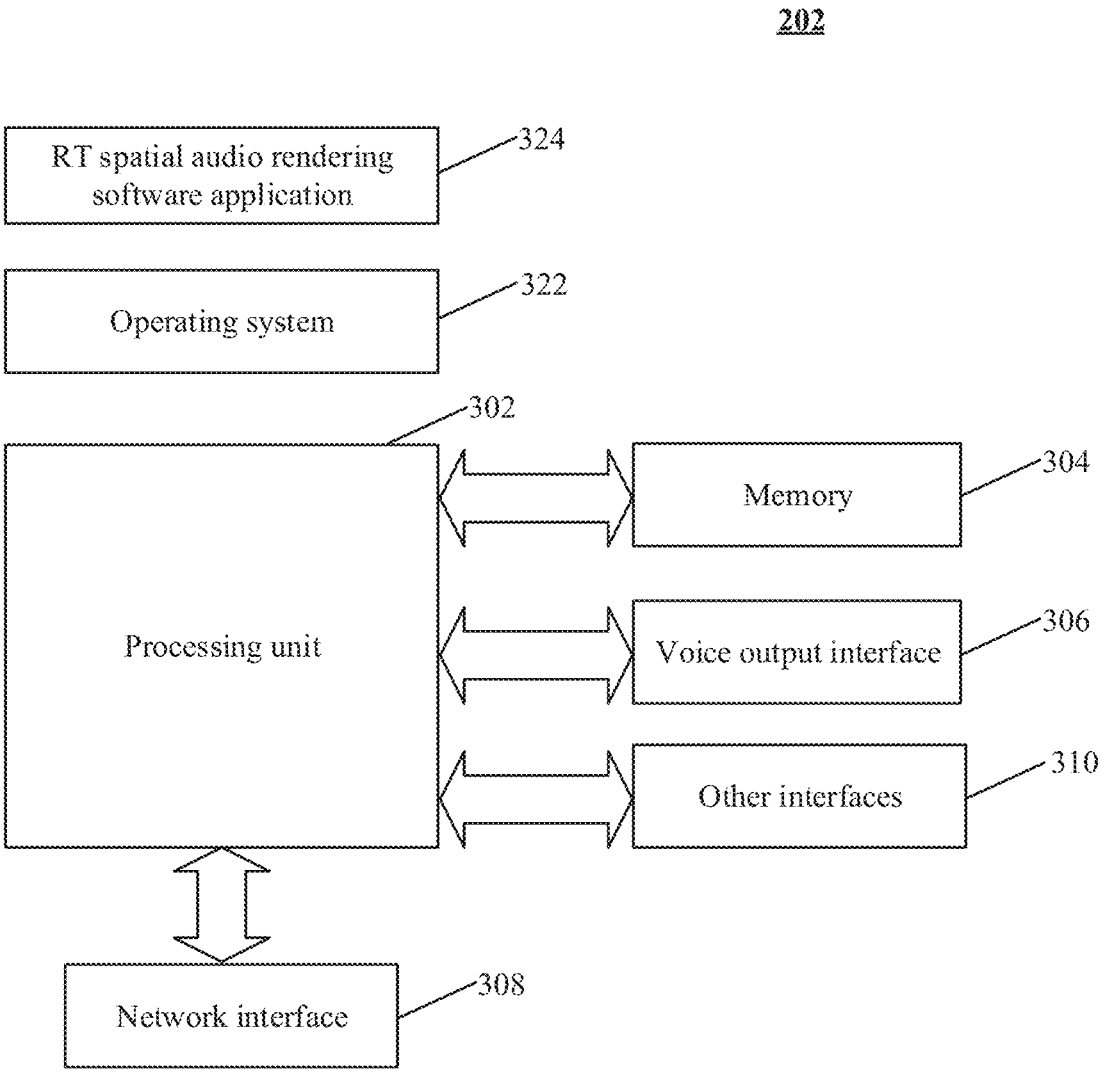
FIG. 3 is a block diagram of a communication device with a real-time spatial audio rendering system in accordance with this disclosure.

The communication device 202 (such as a laptop computer, a tablet computer, a smartphone, etc.), is further illustrated in FIG. 3. Referring now to FIG. 3, a block diagram illustrating the communication device 202 is shown. The device 202 includes a processing unit 302, some amount of memory 304 operatively coupled to the processing unit 302, an audio output interface (such as ear phone interface) 306 operatively coupled to the processing unit 302, a network interface (such as a Wi Fi network interface) 308 operatively coupled to the processing unit 202 for connecting to the Internet 208, and other interfaces (such as a video output interface and an audio input interface) 310. The device 202 also includes an operating system (such as iOS®, Android®, etc.) 322 running on the processing unit 302. One or more computer software applications 324, such as the new RT spatial audio rendering software application mentioned above, are loaded and executed on the device 202. The computer software application 324 are implemented using computer software programming languages, such as C, C++, C#, Java, etc.

Figure 4:
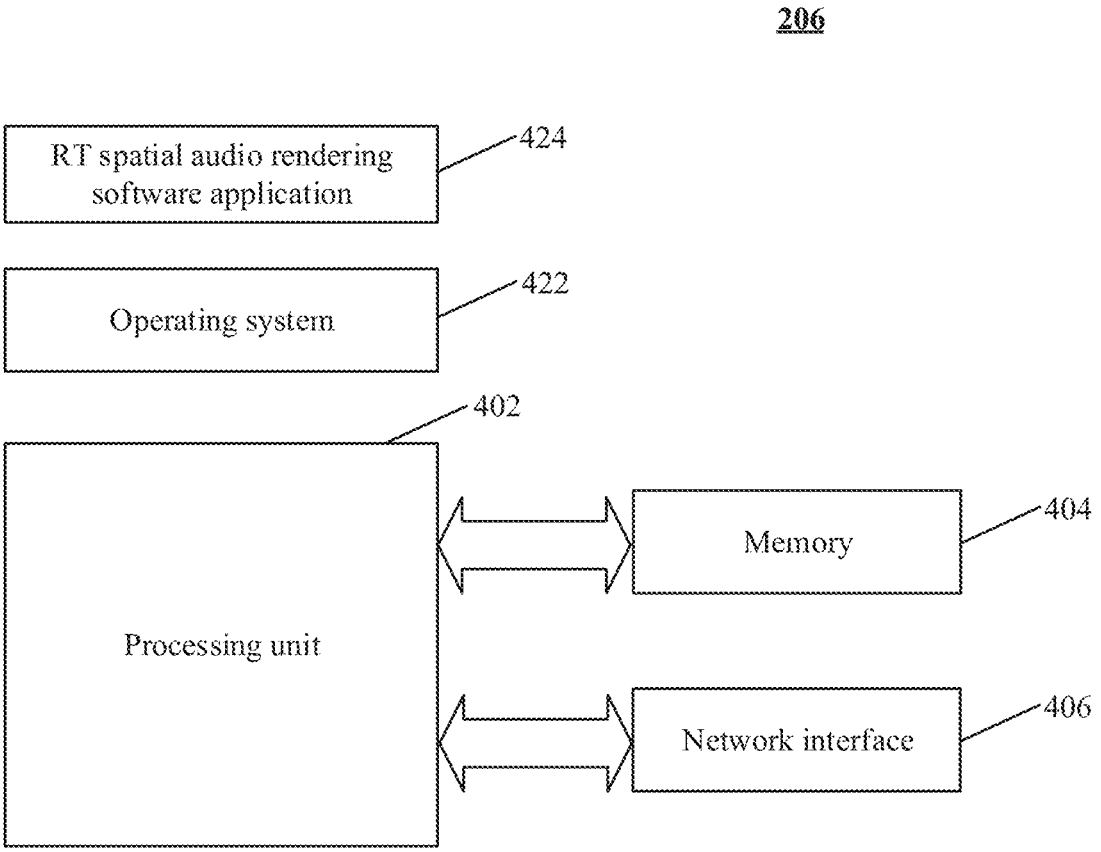
FIG. 4 is a block diagram of a server computer with a real-time spatial audio rendering system in accordance with this disclosure.

The server computer 206 is further illustrated in FIG. 4. Referring now to FIG. 4, a block diagram illustrating the server computer 206 is shown. The server computer 206 includes a processing unit 402, some amount of memory 404 operatively coupled to the processing unit 402, and a network interface (such as a Wi Fi network interface) 406 operatively coupled to the processing unit 402 for connecting to the Internet 208. The server computer 206 also includes an operating system (such as Linux®) 422 running on the processing unit 402. One or more computer software applications 424, such as the new RT spatial audio rendering software application mentioned above, are executed on the server computer 206. The new RT spatial audio rendering software application 424 as a server software application is implemented using computer software programming languages, such as C, C++, C#, Java, etc.

Figure 5:
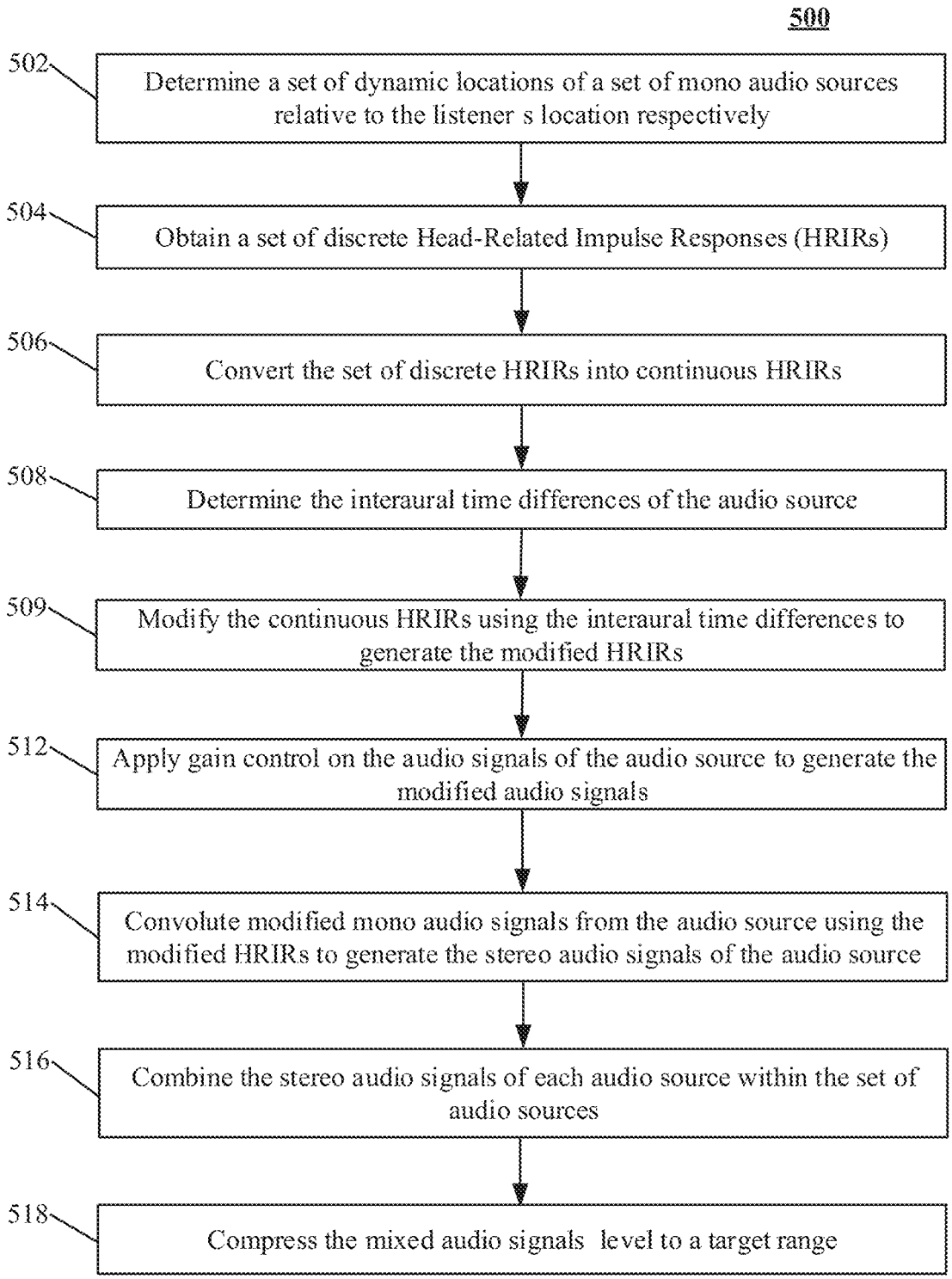
FIG. 5 is a flowchart illustrating a process by which a spatial audio rendering system renders mono format audio signals from one or more sources into stereo format audio without reverberation in accordance with this disclosure.
Figure 6:
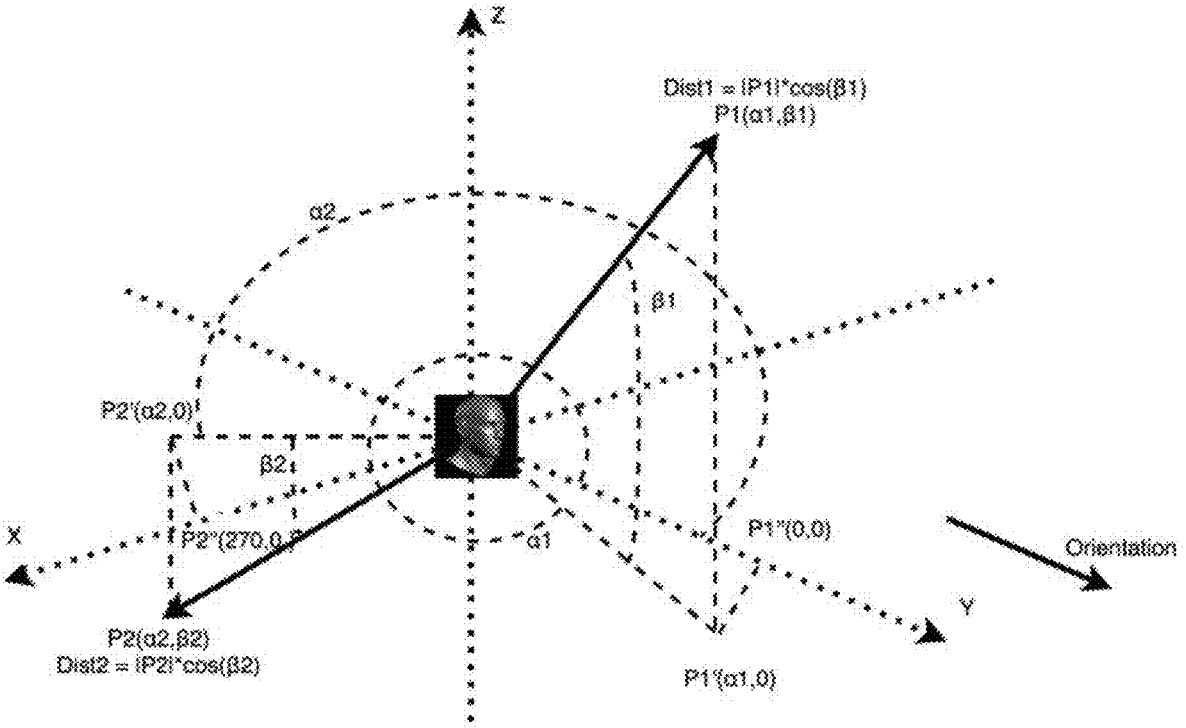
FIG. 6 is an illustrative diagram of a set of mono audio sources' dynamic locations relative to a listener and the listener's orientation in a virtual environment in accordance with this disclosure.

Referring to FIG. 5, a flowchart illustrating a process by which the spatial audio rendering software application 324 (or 424) renders mono format audio signals from one or more sources into stereo format audio without reverberation is shown and generally indicated at 500. At 502, the spatial audio rendering software application determines a set of dynamic locations of a set (meaning one or more) of mono audio sources relative to the listener's location respectively. Each audio source's dynamic location is time dependent since the listener can be moving. Whenever the listener is moving, at different time, an audio source's location relative to the listener is different. The dynamic location is further illustrated by reference to FIG. 6, Referring to FIG. 6, an illustrative diagram of audio sources' dynamic locations relative to the listener and the listener's orientation are shown. In the illustrative scenario, there are two audio sources, P1 and P2 indicated at points P1(a1, β1) and P2(α2, β2) respectively. The listener is indicated at the origin of coordinate system, and the orientation of the listener is indicated by the Y axis. The dynamic locations of two audio sources P1 and P2 at time t are denoted by P1[t] and P2[t] respectively. Each dynamic location is described by the azimuth α, elevation β and distance d. The azimuth α is the angle on the horizontal plane from the Y axis in the anti-clockwise direction. The elevation β is the angle from the vertical/median plane of the X axis and the Y axis. The elevation β thus has a positive value in the direction of the Z axis and a negative value in the opposite direction of the Z axis. The distance d is a Euler distance between the audio source and the listener. The time-dependent dynamic locations, P1[t] and P2[t], of the two audio sources can thus be described as (α1, β1, d1) and (α2, β2, d2) respectively. In a virtual environment system, the dynamic locations P1[t] and P2[t] are provided in real-time.

Turning back to FIG. 5, at 504, the spatial audio rendering software application obtains a set of discrete Head-Related Impulse Responses (HRIRs). The set of discrete HRIRs can be, in one implementation, pre-recorded and presented as a data table. The set of discrete HRIRs can be measured every, for example, 15 degrees in azimuth and elevation and one meter in distance. At each discrete angle (α, β) and distance, there are a set of HRIR data representing the left and right side HRIR. At 506, the spatial audio rendering software application converts the set of discrete HRIRs into continuous HRIRs. In one implementation, the conversion is achieved by interpolation, such as linear interpolation. The elements 504-506 are collectively referred herein as determining the continuous HRIRs.

In real-time, the distance between listener and an audio source can be varying when the listener is mobile. As a result, the distances between the audio source and the listener's two ears are also varying. The latency difference is very important for the sense of space to the listener. Accordingly, at 508, the spatial audio rendering software application determines the interaural time differences (ITD) of each mono audio source within the set of audio sources by calculating the distance of the audio source to each of the listener's two ears and dividing the distances by the sound speed. The ITD calculation is further shown as follows:

$$ITD=a/c*(\theta_I=\sin\theta_I)$$

where a stands for the listener's head circumference, c stands for the speed of sound, and $\theta_I$ is the interaural azimuth in radians. $\theta_I$ is from 0 to π/2 for audio sources on listener's left side, and from π/2 to π for audio sources on listener's right side).

At 510, the spatial audio rendering software application modifies the continuous HRIRs using the interaural time differences to generate modified HRIRs. In one implementation, additional samples of zeros are added to the continuous HRIRs. For example, when the audio source is at left side and the ITD is 1 ms, and the sampling rate of HRIRs is 48000 Hz, 48 samples of zeros are added to the beginning of the right side HRIRs.

At 512, the spatial audio rendering software application applies gain control on the mono audio signals of the audio source. In particular, at 512, an audio source's volume is modified according to the distance between the mono audio source and listener. A gain adjusting the volume is applied to the audio signals from the audio source. The gain follows the volume propagation attenuation rules. In one implementation, the gain calculation is shown as follows:

$$A(d) = A_{ref}^{\log_2\left(\frac{d}{d_{ref}}\right)}$$

Where A(d) is the gain at distance d, $d_{ref}$ is the reference distance, and $A_{ref}$ is the reference gain. $d_{ref}$ and $A_{ref}$ are predefined parameters, meaning that at distance $d_{ref}$, $A_{ref}$ is the amount of gain to be applied to the mono audio signals. The mono audio signals are multiplied by A(d) to generate modified audio signals of the audio source.

At 514, the spatial audio rendering software application convolutes the modified mono audio signals of the audio source by the modified HRIRs (both right and left ears) to generate the stereo audio signals of the audio source. The stereo audio signals include both right and left channels. [How are ITD and A(d) involved/used in this step?]. At 516, the spatial audio rendering software application combines the stereo audio signals of each audio source within the set of audio sources (such as the audio sources P1 and P2 shown in FIG. 6) to generate the combined (or mixed) stereo audio signals for playback on the listener's communication device 202 (or 204). For example, the combination is done by adding the audio signals of all sources together. The combined stereo audio signals from the element 514 is also referred to herein as anechoic audio, anechoic sound, anechoic stereo audio, anechoic stereo audio data, and anechoic stereo audio signals. It should be noted that, when there is only one audio source, the element 516 maintains the same audio signals. In a further implementation, at 518, the spatial audio rendering software application compresses the mixed audio signals to prevent the mixed audio signal from being too loud. For instance, at 518, a dynamic audio compressor is applied to compress the mixed spatial audio signal's level to a target range to prevent the mixed spatial audio from being too loud. The compressed spatial audio of 518 is also referred to herein as compressed anechoic audio.

Figure 7:
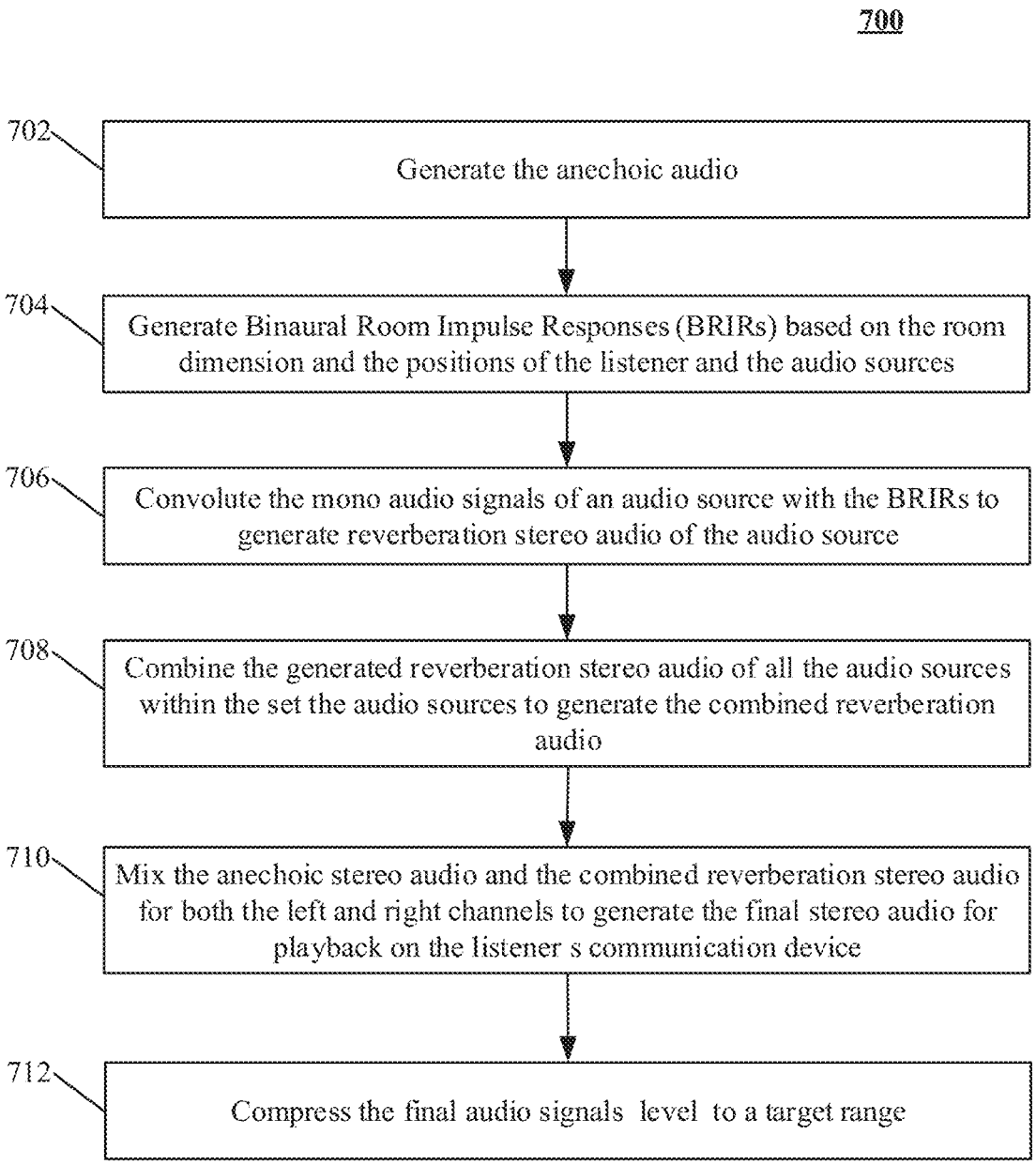
FIG. 7 is a flowchart illustrating a process by which a spatial audio rendering system renders mono format audio signals from one or more sources into stereo format audio with reverberation in accordance with this disclosure.

When the room reverberation is desired for spatial audio rendering, the reverberation based on the Binaural Room Impulse Response (BRIR) is added during the spatial audio rendering. Referring to FIG. 7, a flowchart illustrating a process by which the spatial audio rendering software application renders mono format audio signals from one or more sources into stereo format audio with reverberation is shown and generally indicated at 700. At 702, the spatial audio rendering software application generates the anechoic audio. In one implementation, at 702, the spatial audio rendering software application performs the elements 502-516. The stereo audio generated by the element 516 is the anechoic audio.

Figure 8:
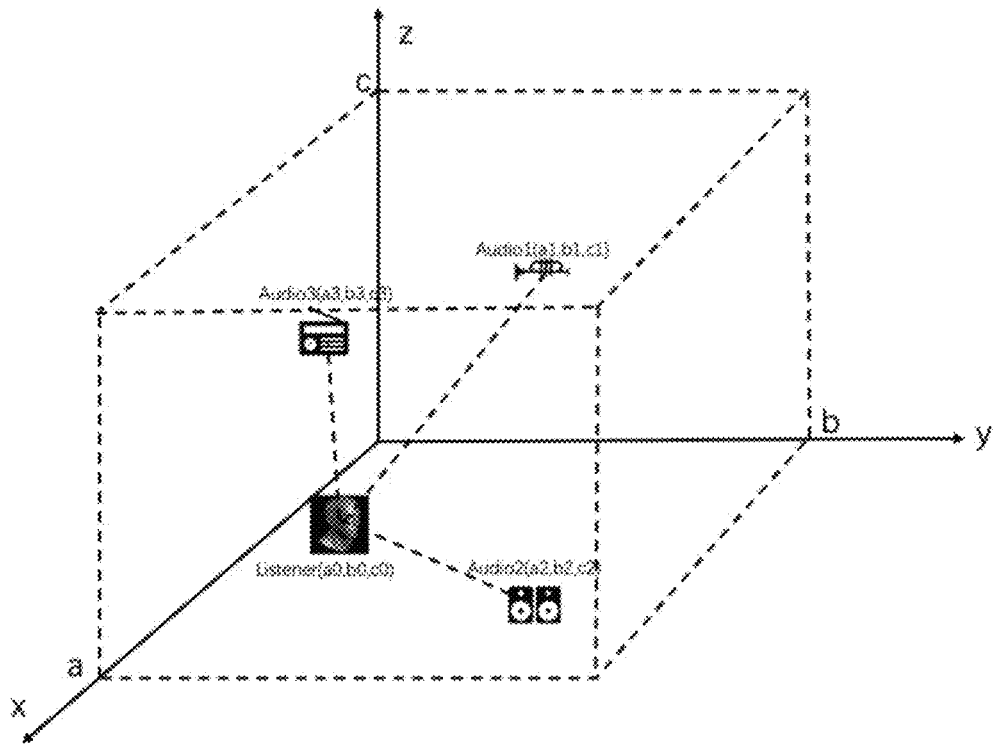
FIG. 8 is an illustrative virtual room in accordance with this disclosure.

At 704, the spatial audio rendering software application generates BRIRs based on the room dimension and the positions of the listener and the audio sources. An illustrative virtual room is shown in FIG. 8. In one implementation, the real-time BRIRs are generated using the image method or image source method (ISM). With the ISM method, when a sound wave hits a rigid wall, the reflection of the wave signal is considered the same as the sound wave coming from an image source behind the wall. The sound wave is reflected multiple times before entering the listener's ear. Accordingly, the reverberation is simulated by a summation of a finite number of image sources. Depending on the room dimension and locations of the listener and mono audio sources, the refection routes between the audio sources and the listener are different. For each audio source, a set of BRIRs is estimated using the ISM method.

At 706, the spatial audio rendering software application convolutes the mono audio signals of an audio source with the BRIRs to generate reverberation stereo audio (also referred to herein as reverberation audio and reverberation audio signals) of the audio source. At 708, the spatial audio rendering software application combines the generated reverberation stereo audio signals of all the audio sources within the set the audio sources (such as P1 and P2) to generate the combined reverberation stereo audio signals (or reverberation audio for short). In one implementation, the combination is achieved by adding the reverberation stereo audio signals of the set the audio sources together using the following equation:

$$s_{overall} = \sum_{i=0}^{n} s_i$$

where $S_i$ stands for the reverberation stereo audio data of the i-th audio source and n stands for the number of audio sources.

At 710, the spatial audio rendering software application mixes the anechoic stereo audio and the combined reverberation stereo audio for both the left and right channels to generate the final stereo audio for playback on the device 202. In one implementation, the mixing is the addition of the two categories of audio data. In a further implementation, at 712, the spatial audio rendering software application compresses the final audio signals's level to a target range to prevent the playback from being too loud. For instance, at 712, a dynamic audio compressor is applied to compress the final audio signal level to a target range.

Obviously, many additional modifications and variations of the present disclosure are possible in light of the above teachings. Thus, it is to be understood that, within the scope of the appended claims, the disclosure may be practiced otherwise than is specifically described above.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A computer-implemented method for rendering real-time spatial audio from mono audio sources in a virtual environment, said method performed by a real-time spatial audio rendering computer software application within a real-time spatial audio rendering system and comprising:

1) determining whether reverberation is configured for rendering spatial audio from a set of mono audio sources;
2) determining a set of dynamic locations of said set of mono audio sources relative to a listener's location in a virtual environment respectively;
3) obtaining a set of discrete Head-Related Impulse Responses (HRIRs);

4) converting said set of discrete HRIRs into continuous HRIRs;

5) determining interaural time differences of each mono audio source within said set of mono audio sources based on said set of dynamic locations;

6) modifying said continuous HRIRs with said interaural time differences to generate modified HRIRs;

7) applying gain control on audio signals of each mono audio source within said set of mono audio sources to generate modified audio signals;

8) convoluting said modified audio signals by said modified HRIRs to generate spatial audio signals of each mono audio source within said set of mono audio sources; and 9) combining said spatial audio signals of all mono audio sources within said set of mono audio sources to generate anechoic audio, said anechoic audio adapted to be played back by said communication device.

2. The method of claim 1, wherein said spatial audio is stereo audio.

3. The method of claim 1 further comprising compressing said anechoic audio's level to a target range for playback by said communication device wherein said spatial audio is stereo audio.

4. The method of claim 1, when reverberation is configured, further comprising:

1) generating Binaural Room Impulse Responses (BRIRs) based on a set of dimensions of a room of said listener and positions of said listener and said set of mono audio sources;

2) convoluting said audio signals of each mono audio source within said set of mono audio sources with said BRIRs to generate reverberation stereo audio of each mono audio source within said set of mono audio sources;

3) combining said reverberation stereo audio of all mono audio source within said set of mono audio sources to generate combined reverberation audio; and 4) mixing said anechoic audio with said combined reverberation audio for both a left channel and a right channel to generate final spatial audio for playback on said communication device.

5. The method of claim 4, wherein said spatial audio is stereo audio.

6. The method of claim 4 further comprising compressing said final spatial audio's level to a target range.

7. The method of claim 6, wherein said spatial audio is stereo audio.

8. A real-time spatial audio rendering system having a real-time spatial audio rendering computer software application adapted to run on a communication device, said real-time spatial audio rendering computer software application adapted to:

1) determine whether reverberation is configured for rendering spatial audio from a set of mono audio sources;

2) determine a set of dynamic locations of said set of mono audio sources relative to a listener's location in a virtual environment respectively;

3) obtain a set of discrete Head-Related Impulse Responses (HRIRs);

4) convert said set of discrete HRIRs into continuous HRIRs;

5) determine interaural time differences of each mono audio source within said set of mono audio sources set of dynamic locations;

6) modify said continuous HRIRs with said interaural time differences to generate modified HRIRs;

7) apply gain control on audio signals of each mono audio source within said set of mono audio sources to generate modified audio signals;

8) convolute said modified audio signals by said modified HRIRs to generate spatial audio signals of each mono audio source within said set of mono audio sources; and 9) combine said spatial audio signals of all mono audio sources within said set of mono audio sources to generate anechoic audio, said anechoic audio adapted to be played back by said communication device.

9. The real-time spatial audio rendering system of claim 8, wherein said spatial audio is stereo audio.

10. The real-time spatial audio rendering system of claim 8, wherein said real-time spatial audio rendering computer software application is further adapted to compress said anechoic audio's level to a target range for playback by said communication device.

11. The real-time spatial audio rendering system of claim 10, wherein said spatial audio is stereo audio.

12. The real-time spatial audio rendering system of claim 8, wherein, when reverberation is configured, said real-time spatial audio rendering computer software application is further adapted to:

1) generate Binaural Room Impulse Responses (BRIRs) based on a set of dimensions of a room of said listener and positions of said listener and said set of mono audio sources;

2) convolute said audio signals of each mono audio source within said set of mono audio sources with said BRIRs to generate reverberation stereo audio of each mono audio source within said set of mono audio sources;

3) combine said reverberation stereo audio of all mono audio source within said set of mono audio sources to generate combined reverberation audio; and 4) mix said anechoic audio with said combined reverberation audio for both a left channel and a right channel to generate final spatial audio for playback on said communication device.

13. The real-time spatial audio rendering system of claim 12, wherein said spatial audio is stereo audio.

14. The real-time spatial audio rendering system of claim 12, wherein said real-time spatial audio rendering computer software application is further adapted to compress said final spatial audio's level to a target range.

15. The real-time spatial audio rendering system of claim 14, wherein said spatial audio is stereo audio.

* * * * *